US006788909B2

(12) United States Patent
Prichett

(10) Patent No.: US 6,788,909 B2
(45) Date of Patent: Sep. 7, 2004

(54) COUPLING ARRANGEMENT INCLUDING DRUM, FLANGE, AND CONNECTOR

(75) Inventor: Umiller Prichett, Chesapeake, VA (US)

(73) Assignee: Mitsubishi Chemical America, Inc., Chesapeake, VA (US)

( * ) Notice: Subject to any disclaimer, the term of this patent is extended or adjusted under 35 U.S.C. 154(b) by 0 days.

(21) Appl. No.: 10/448,073

(22) Filed: May 30, 2003

(65) Prior Publication Data

US 2003/0223773 A1 Dec. 4, 2003

Related U.S. Application Data

(60) Provisional application No. 60/384,103, filed on May 31, 2002.

(51) Int. Cl.[7] ..... G03G 15/00
(52) U.S. Cl. ..... 399/117; 399/90
(58) Field of Search ..... 399/107, 116, 399/117, 159, 167, 90

(56) References Cited

U.S. PATENT DOCUMENTS

| | | | | |
|---|---|---|---|---|
| 4,527,883 | A | | 7/1985 | Kamiyama |
| 4,833,502 | A | | 5/1989 | Azuma |
| 4,839,690 | A | | 6/1989 | Onoda et al. |
| 5,023,660 | A | | 6/1991 | Ebata et al. |
| 5,052,090 | A | | 10/1991 | Kitaura et al. |
| 5,126,800 | A | | 6/1992 | Shishido et al. |
| 5,128,715 | A | * | 7/1992 | Furuyama et al. ..... 399/116 |
| 5,151,734 | A | | 9/1992 | Tsuda et al. |
| 5,210,574 | A | | 5/1993 | Kita |
| 5,347,343 | A | | 9/1994 | Ohtsuka et al. |
| 5,461,464 | A | | 10/1995 | Swain |
| 5,500,714 | A | | 3/1996 | Yashiro et al. |
| 5,579,085 | A | | 11/1996 | Miyabe et al. |
| 5,594,531 | A | | 1/1997 | Shishido et al. |
| 5,599,265 | A | | 2/1997 | Foltz |
| 5,655,182 | A | | 8/1997 | Sanchez et al. |
| 5,729,792 | A | | 3/1998 | Ikehara |
| 5,739,900 | A | | 4/1998 | Isobe |
| 5,768,943 | A | | 6/1998 | Kawata et al. |
| 5,771,425 | A | | 6/1998 | Yamada et al. |
| 5,842,962 | A | | 12/1998 | Yamada et al. |
| 5,878,310 | A | | 3/1999 | Noda et al. |
| 5,907,750 | A | | 5/1999 | Yamada et al. |
| 5,943,527 | A | | 8/1999 | Kashiwagi et al. |
| 5,953,562 | A | | 9/1999 | Kawaguchi et al. |
| 5,991,571 | A | | 11/1999 | Yamada et al. |
| 5,999,771 | A | | 12/1999 | Wakihara |
| 6,072,968 | A | | 6/2000 | Nomura et al. |
| 6,097,909 | A | | 8/2000 | Watanabe et al. |
| 6,167,219 | A | | 12/2000 | Miyamoto et al. |
| 6,175,706 | B1 | | 1/2001 | Watanabe et al. |
| 6,226,478 | B1 | | 5/2001 | Watanabe et al. |
| 6,240,266 | B1 | | 5/2001 | Watanabe et al. |

* cited by examiner

*Primary Examiner*—Hoang Ngo
(74) *Attorney, Agent, or Firm*—Oblon, Spivak, McClelland, Maier & Neustadt, P.C.

(57) ABSTRACT

A coupling arrangement having an optical photo-conductive drum including drum exterior and interior surfaces surrounding and extending along a longitudinal axis, the drum exterior surface facing away from the longitudinal axis, and the drum interior surface facing toward the longitudinal axis and including first and second open ends and at least one drum receiving portion. A flange includes a flange interior surface disposed in the first open end, a flange exterior surface disposed outside of the first open end, a flange side surface connecting the flange interior and exterior surfaces, and at least one flange receiving portion. At least one connector is disposed in the at least one drum receiving portion and the at least one flange receiving portion to connect and/or to secure the optical photo-conductive drum and the flange.

32 Claims, 5 Drawing Sheets

| GEAR TYPE | APPLIED TORQUE- 1 PIN | APPLIED TORQUE- 2 PARALLEL PINS |
|---|---|---|
| HELICAL | 41.5 in-lb | 61.7 in-lb |
| SPUR | 41.3 in-lb | 30.0 in-lb |

| GEAR TYPE | APPLIED PULL FORCE- 1 PIN | APPLIED PULL FORCE- 2 PARALLEL PINS |
|---|---|---|
| HELICAL | 13.3 kgf | 41.9 kgf |
| SPUR | 13.6 kgf | 22.6 kgf |

*FIG. 5*

COUPLING ARRANGEMENT INCLUDING DRUM, FLANGE, AND CONNECTOR

CROSS-REFERENCE TO RELATED APPLICATIONS

This application claims the benefit of priority to U.S. provisional application No. 60/384,103 to Prichett, filed May 31, 2002, the disclosure of which is incorporated by reference herein in its entirety.

BACKGROUND OF THE INVENTION

1. Field of the Invention

The present invention relates to a coupling arrangement including an optical photo-conductive (OPC) drum, a flange (e.g., a driving flange and/or a driven flange), and a connector in an electro-photographic (EP) machine, and more particularly to a coupling arrangement including a connector disposed in receiving portions of the OPC drum and the flange.

2. Discussion of the Related Art

In a known electro-photographic (EP) machine, such as a photocopier, a laser printer, and a facsimile, a known process cartridge is removably mounted to a known main assembly.

The main assembly of the EP machine generally includes, among other components, a housing, a control panel disposed within the housing for controlling an image forming process, an electronic control system that is operated by the control panel, a motor that is controlled by the control system, a gear train that is driven by the motor, and electrical contacts for delivering power to the process cartridge that is inserted into and retained within grooves or channels formed in opposing side walls of the housing. The main assembly generally also includes an optical projection system and a central processor that controls a sequence and a timing of the optical projection system during a known image forming operation.

The process cartridge generally includes, among other components, an optical photo-conductive (OPC) drum, and a driving gear for driving one or more components of the process cartridge, such as a charging device, a developing device, and a cleaning device.

During the known image forming operation, the OPC drum undergoes a charging portion and a discharging portion of a charging/discharging cycle to ultimately create a developer image (e.g., a toner image) on a recording material (e.g., a sheet of paper, a transparent sheet, etc.). Briefly, during the charging portion of the charging/discharging cycle, the charging device uniformly charges an exterior surface of the OPC drum. The optical projection system projects image containing information in the form of a laser light to selectively discharge a portion of the exterior surface of the OPC drum, thereby forming a latent image on the OPC drum. The developing device applies a developer (e.g., a toner) to the partially charged exterior surface of the OPC drum. The developer is electro-statically attracted to the charged areas of the OPC drum, thereby forming the developer image. The developer image is then transferred from the exterior surface of the OPC drum to the recording material.

In the known process cartridge, the exterior surface of the OPC drum is coated with an electrically resistive coating to improve a quality of the image produced during the image forming process. Examples of known electrically resistive coatings include hard anodization with aluminum oxide ($Al_2O_3$) and oxidized surfaces. Generally, during a coating process, the OPC drum is submerged in the electrically resistive coating, such that an interior surface of the OPC drum, as well as the exterior surface, is coated with the electrically resistive coating.

It is known that the coated interior surface of the OPC drum must be sufficiently grounded for the OPC drum to undergo the required discharging portion of the charging/discharging cycle. In a known grounding or earthing arrangement, a grounding plate is disposed beneath the driving gear and within an interior portion of the OPC drum. The grounding plate includes a plurality of first radially extending projections that contact the interior surface of the OPC drum. To satisfactorily ground the OPC drum with the coated interior surface, the electrically resistive coating must be removed from a contact area of the interior surface through a separate and additional process (i.e., a process after the coating of the OPC drum), such that the first projections can be aligned to achieve electrical connection with the interior surface of the OPC drum. An example of a known process for removing the electrically resistive coating includes a laser scribing operation. The grounding plate also includes a plurality of second radially extending projections that contact an electrically conductive shaft extending through the driving gear.

Thus, during assembly of the known process cartridge, the grounding plate is aligned with the contact areas and inserted into the OPC drum, such that the first projections of the grounding plate achieve electrical connection with the contact areas of the OPC drum. The driving gear is then secured to the OPC drum by known securing means, thereby preventing relative movement and rotation, and preventing disassembly, among the OPC drum, the driving gear, and the grounding plate. Examples of securing means include an adhesive and a press fit arrangement. The electrically conductive shaft extends through the driving gear, and achieves electrical connection with the second projections of the grounding plate. By these arrangements, the OPC drum is sufficiently grounded through the grounding plate and the electrically conductive shaft.

However, the known OPC drum assembly suffers from a number of disadvantages. For example, during curing of the adhesive, care must be taken to maintain precise alignment and to prevent relative rotation and movement of the driving gear and the grounding plate relative to the contact areas of the OPC drum. Failure to maintain precise alignment may result in failure to achieve sufficient grounding of the OPC drum. The requirement to maintain precise alignment acts as an impediment to an automatic assembly of the OPC drum assembly. Further, the inadvertent use of an undesirably large volume of adhesive may result in adhesive flow into undesired portions of the known OPC drum assembly, and may degrade performance of the OPC drum assembly. The use of an undesirably small volume of adhesive may result in poor bond formation and inadequate bond strength between the OPC drum and the driving gear, and may reduce a useful life of the OPC drum assembly. Further, the press fit arrangement requires a relatively high degree of mechanical precision of each of the OPC drum and the driving gear (e.g., tolerances related to cylindricity of the driving gear and the OPC drum) to achieve satisfactory securing of the OPC drum and the driving gear. Such disadvantages increase a manufacturing time and/or a manufacturing cost of the known OPC drum assembly.

SUMMARY OF THE INVENTION

The present invention provides a coupling arrangement having an optical photo-conductive drum including drum exterior and interior surfaces surrounding and extending along a longitudinal axis, the drum exterior surface facing away from the longitudinal axis, and the drum interior surface facing toward the longitudinal axis and including first and second open ends and at least one drum receiving portion. A flange includes a flange interior surface disposed in the first open end, a flange exterior surface disposed outside of the first open end, a flange side surface connecting the flange interior and exterior surfaces, and at least one flange receiving portion. At least one connector is disposed in the at least one drum receiving portion and the at least one flange receiving portion to connect and secure the optical photo-conductive drum and the flange.

The present invention further provides a process cartridge adapted to be removably mounted on an electro-photographic machine including a coupling arrangement. The coupling arrangement has an optical photo-conductive drum including drum exterior and interior surfaces surrounding and extending along a longitudinal axis, the drum exterior surface facing away from the longitudinal axis, and the drum interior surface facing toward the longitudinal axis and including first and second open ends and at least one drum receiving portion. A flange includes a flange interior surface disposed in the first open end, a flange exterior surface disposed outside of the first open end, a flange side surface connecting the flange interior and exterior surfaces, and at least one flange receiving portion. At least one connector is disposed in the at least one drum receiving portion and the at least one flange receiving portion to connect and secure the optical photo-conductive drum and the flange.

The present invention further provides an electro-photographic machine including a main portion and a coupling arrangement removably mounted on the main portion. The coupling arrangement has an optical photo-conductive drum including drum exterior and interior surfaces surrounding and extending along a longitudinal axis, the drum exterior surface facing away from the longitudinal axis, and the drum interior surface facing toward the longitudinal axis and including first and second open ends and at least one drum receiving portion. A flange includes a flange interior surface disposed in the first open end, a flange exterior surface disposed outside of the first open end, a flange side surface connecting the flange interior and exterior surfaces, and at least one flange receiving portion. At least one connector is disposed in the at least one drum receiving portion and the at least one flange receiving portion to connect and secure the optical photo-conductive drum and the flange.

The present invention further provides a coupling arrangement having an optical photo-conductive drum including drum exterior and interior surfaces surrounding and extending along a longitudinal axis, the drum exterior surface facing away from the longitudinal axis, and the drum interior surface facing toward the longitudinal axis and including first and second open ends and a first securing means. A flange includes a flange interior surface disposed in the first open end, a flange exterior surface disposed outside of the first open end, a flange side surface connecting the flange interior and exterior surfaces, and a second securing means. Connecting and securing means are disposed in the first and second means.

The present invention further provides a method of assembling a coupling arrangement having an optical photo-conductive drum and a flange including an interior surface disposed inside the optical photo-conductive drum, an exterior surface disposed opposite the interior surface, and a side surface connecting the interior and exterior surfaces. The method includes disposing a connector in the side surface of the flange, and inserting the flange that includes the connector inside the optical photo-conductive drum.

The present invention still further provides a method of grounding a coupling arrangement including an optical photo-conductive drum and a flange including an interior surface disposed inside the optical photo-conductive drum, an exterior surface disposed opposite the interior surface, and a side surface connecting the interior and exterior surfaces. The method includes disposing a connector in the side surface of the flange, and inserting the flange that includes the connector inside the optical-photoconductive drum to achieve electrical connection between the inside of the optical photo-conductive drum and the connector, and securing the flange to the optical photo-conductive drum.

BRIEF DESCRIPTION OF THE DRAWINGS

A more complete appreciation of the present invention, and many of the attendant advantages thereof, will be readily ascertained and/or obtained as the same becomes better understood by reference to the following detailed description when considered in connection with the accompanying drawings, wherein:

FIG. 5 shows experimental results for strength tests of embodiments of the coupling arrangement according to the present invention.

DETAILED DESCRIPTION OF THE PREFERRED EMBODIMENTS

Figure 1:
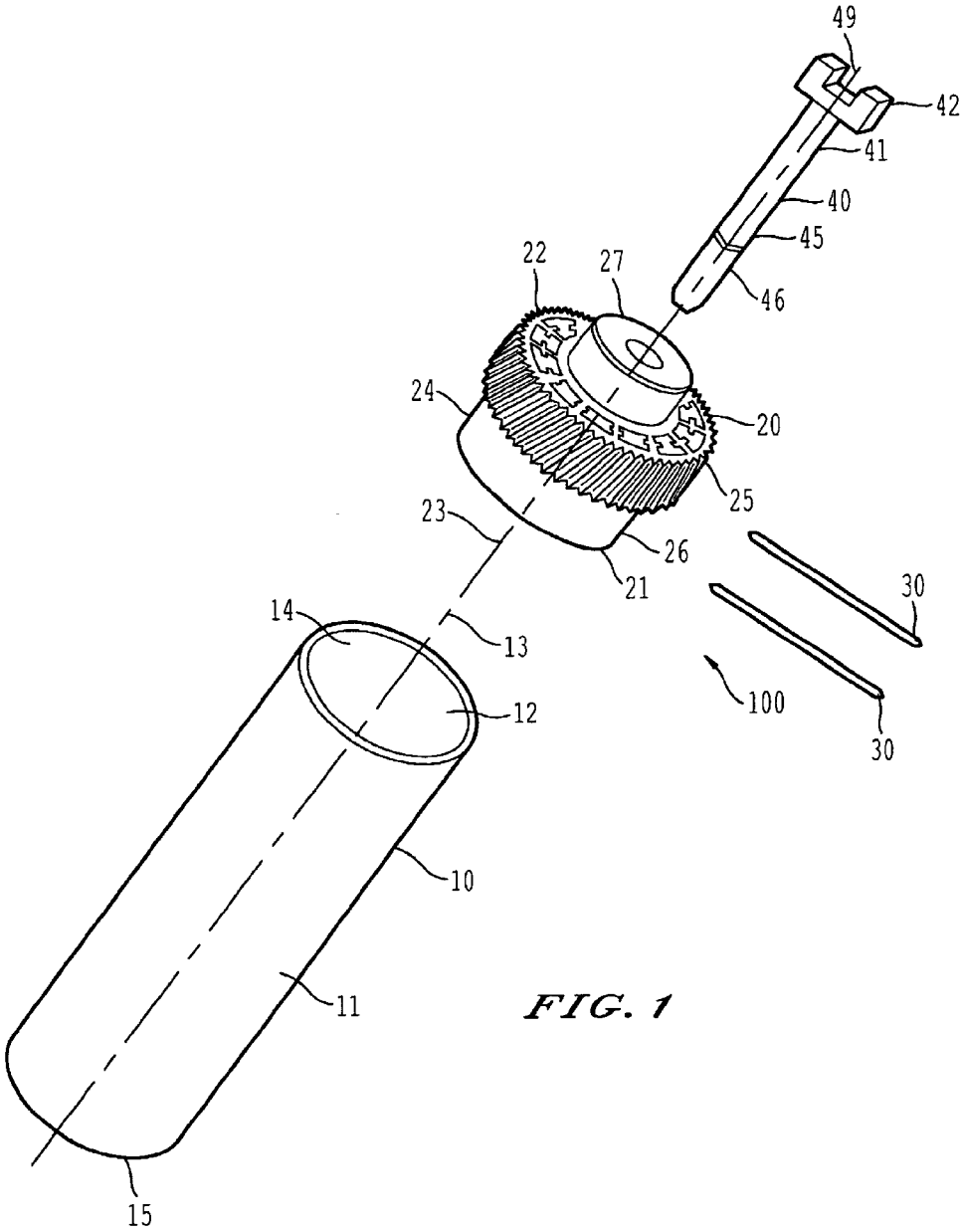
FIG. 1 shows an exploded isometric view of a coupling arrangement including an optical photo-conductive (OPC) drum, a flange, and a connector/securement according to the present invention.
Figure 2:
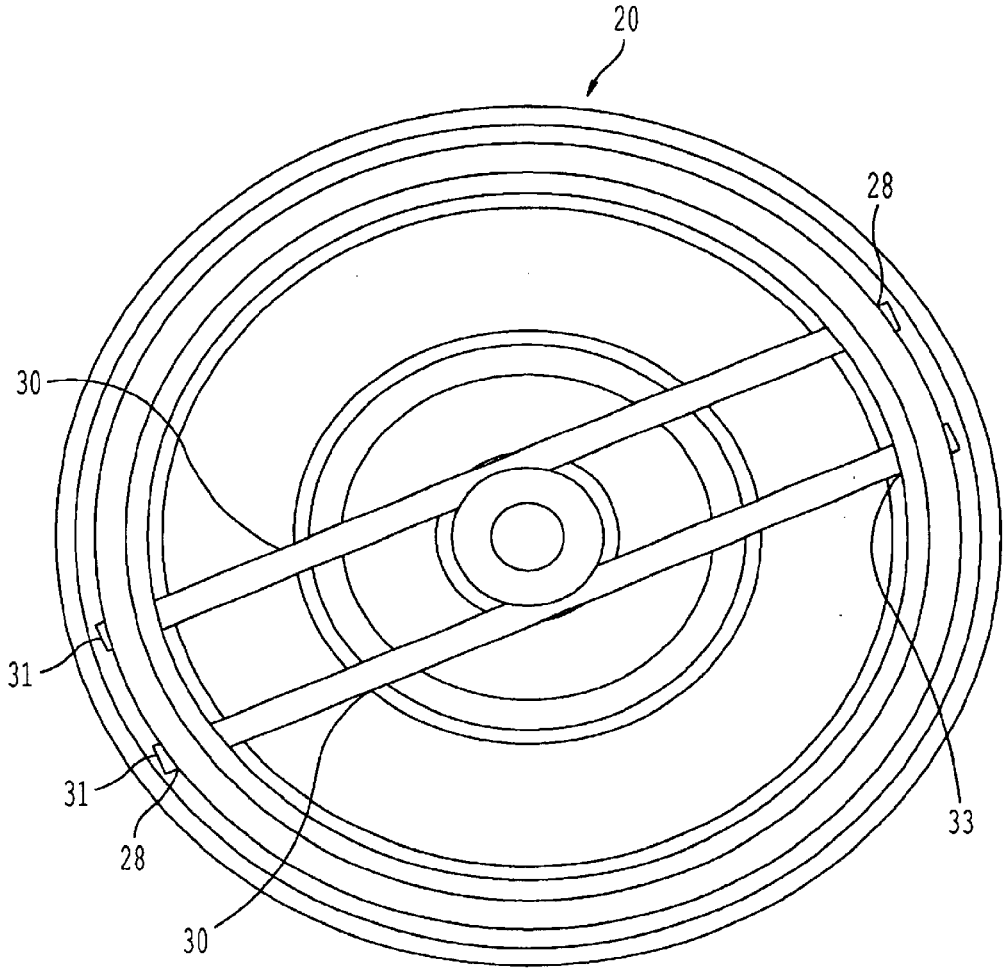
FIG. 2 shows a bottom view of the flange and connector/securement of FIG. 1.
Figure 3:
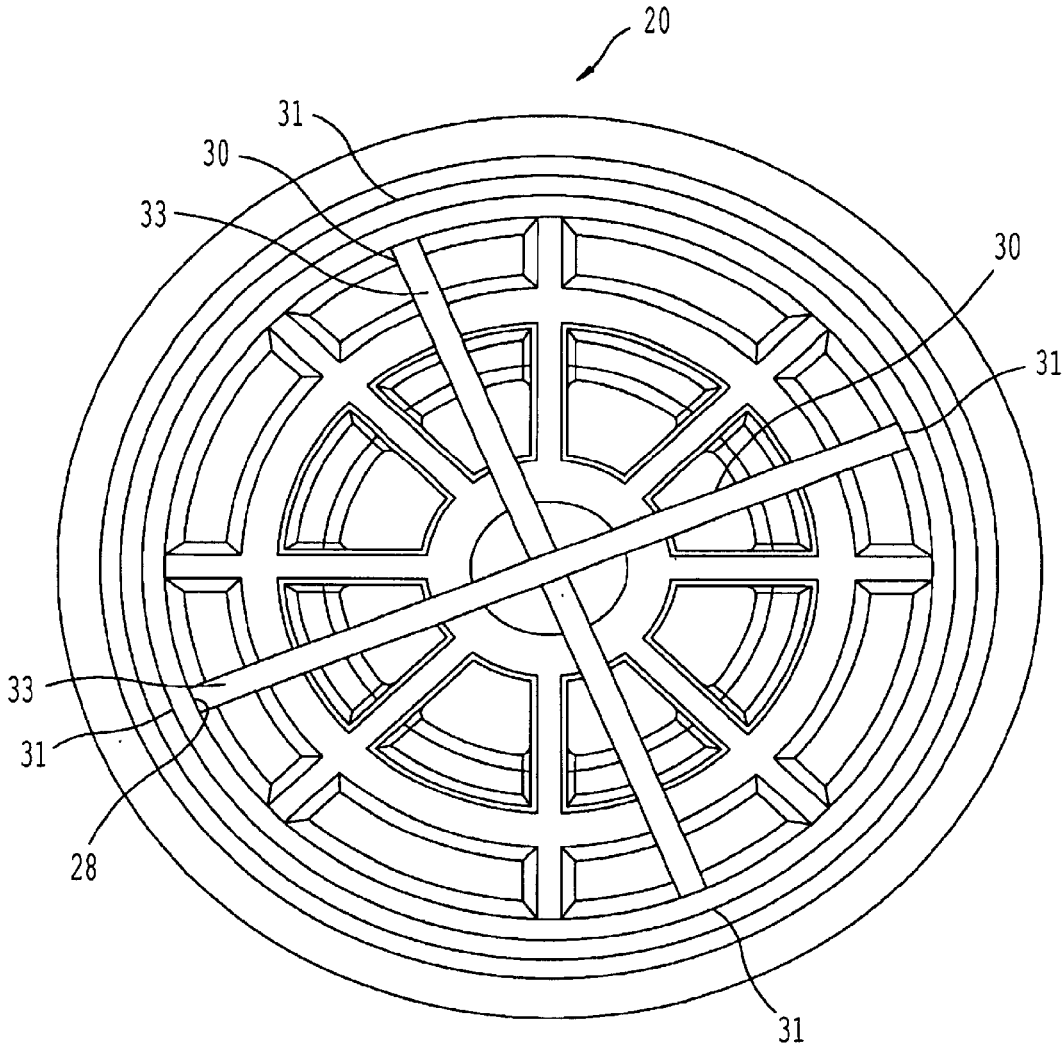
FIG. 3 shows a bottom view of another embodiment of a flange and a connector/securement according to the present invention.
Figure 4:
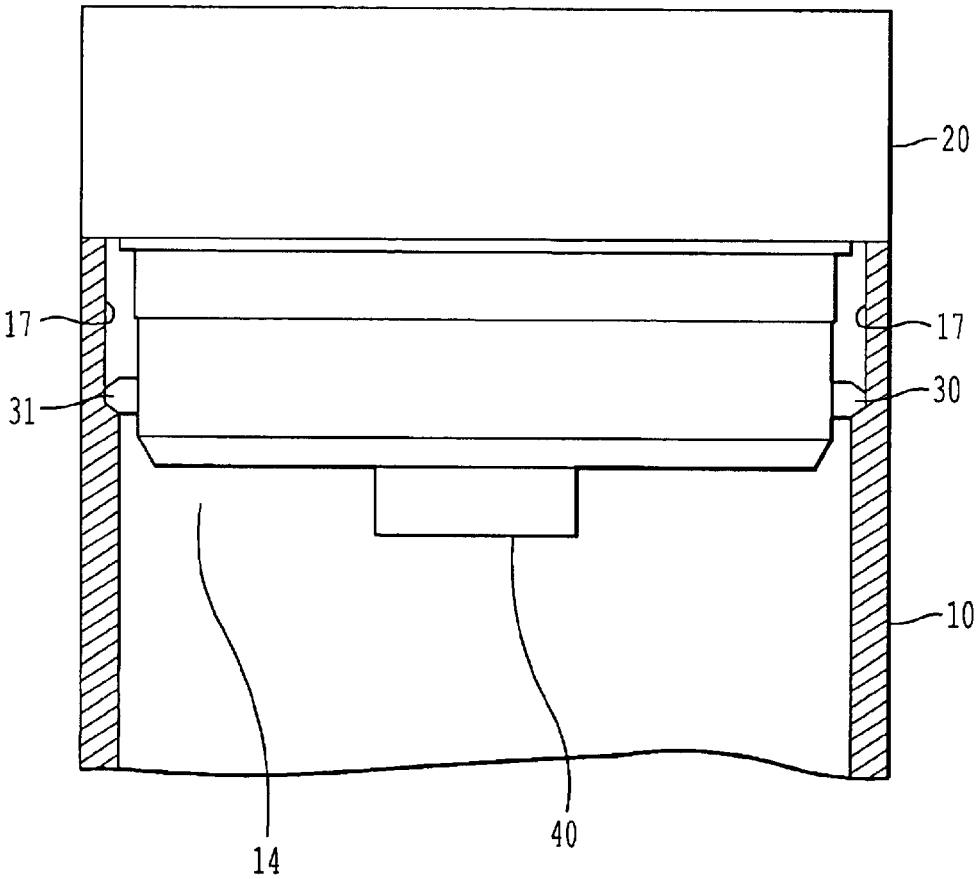
FIG. 4 shows an elevation partial cross-sectional view of the coupling arrangement of FIG. 1.

Examples of preferred embodiments of the present invention will now be described with reference to the drawings, wherein like reference numbers throughout the several views identify like and/or similar elements.

The figures show an example of a coupling arrangement that can include an optical photo-conductive (OPC) drum, a flange (e.g., a driving flange and/or a driven flange), and a connector/securement of a process cartridge removably mounted to a main assembly of an electro-photographic (EP) machine.

In certain preferred embodiments of the present invention, the coupling arrangement can have the optical photo-conductive (OPC) drum including drum exterior and interior surfaces surrounding and extending along a longitudinal axis, the drum exterior surface facing away from the longitudinal axis, and the drum interior surface facing toward the longitudinal axis and including first and second open ends and a drum receiving portion. The flange can include a flange interior surface disposed in the first open end, a flange exterior surface disposed outside of the first open end, a flange side surface connecting the flange interior and exterior surfaces, and a flange receiving portion. The connector/securement can be disposed in the drum receiving portion and the flange receiving portion to connect the OPC drum and the flange. By this arrangement, the OPC drum can be secured with and prevented from rotation and/or movement relative to the flange. The coupling arrangement can be secured without the use of additional securing means, such as an adhesive and/or a press fit arrangement between the OPC drum and the flange. Further, the coupling arrangement can achieve electrical connection between the OPC drum and the connector/securement and/or can ground the OPC drum and the connector/securement with or without the grounding plate.

Specifically, as shown in the figures, a coupling arrangement 100 according to the present invention can include, among other components, an optical photo-conductive (OPC) drum 10, a flange (e.g., a driving flange and/or a driven flange) 20, a connector/securement (connector) 30, and a grounding shaft 40, examples of which are discussed below.

During an image forming process, an electro-static latent image and a subsequent developer image (i.e., a toner image) can be formed on the OPC drum 10 for transfer to a recording material (e.g., a sheet of paper, a transparent sheet, etc.). Thus, although the drawings show certain preferred embodiments of the OPC drum 10, it is to be understood that the OPC drum 10 can be of any type on which an electro-static latent image and/or a developer image can be formed.

As shown in the figures, the OPC drum 10 can include a drum exterior surface 11 and a drum interior surface 12 to define a side wall, and the drum exterior and interior surfaces 11 and 12 can extend about along, and can be about coaxial with, a longitudinal axis 13. The drum exterior surface 11 can face away from the longitudinal axis 13, and the drum interior surface 12 can face toward the longitudinal axis 13. By this arrangement, the drum exterior and interior surfaces 11 and 12 can define the OPC drum 10, such that the OPC drum 10 can be about cylindrical in shape. The drum interior surface 12 can include first and second open ends 14 and 15, respectively.

At least one of the drum exterior surface 11 and the drum interior surface 12 can include an electrically resistive coating, such as a hard anodization with aluminum oxide ($Al_2O_3$) and/or oxidized surfaces. The electrically resistive coating can be formed on the drum exterior surface 11 to improve a quality of the image formed thereon in the image forming process, and the electrically resistive coating can be formed on the drum interior surface 12 as a consequence of the formation of the coating on the drum exterior surface 11 (e.g., by submerging the OPC drum 10 into the coating during a known coating process). The electrically resistive coating can be sufficiently electrically resistive so as to impede a discharging portion of a charging/discharging cycle of the OPC drum 10, such that removal of a portion of the electrically resistive coating from a contact area of the drum interior surface 12 can improve electrical connection therewith, and can achieve the image formed in the image forming process. The OPC drum 10 can be of any material that can be used in the formation of the latent image and/or in the formation of the developer image, such as aluminum.

The OPC drum 10 can include at least one drum receiving portion 17 in which the connector 30 can be disposed (discussed below). By this arrangement, the OPC drum 10 can be secured with and can be prevented from rotation and/or movement relative to the flange 20. The coupling arrangement 100 can be secured without the use of additional securing means, such as an adhesive and/or a press fit arrangement between the OPC drum 10 and the flange 20. Further, the coupling arrangement 100 can achieve electrical connection between the OPC drum 10 and the connector 30, and/or can ground the OPC drum 10 and the connector 30.

In a preferred embodiment of the invention, the at least one drum receiving portion 17 can have a shape that can be a consequence of methods of assembling the coupling arrangement 100 (discussed below). Preferably, the at least one drum receiving portion 17 can be in the form of a channel or groove that can extend from the first open end 14 and can have a depth that can be equal to about ⅓ of a thickness of the side wall between the exterior and interior surfaces 11 and 12 of the OPC drum 10. The at least one drum receiving portion 17 can have a cross-sectional shape that includes one or more of an arc, an ellipse, a circle, and an equivalent arcuate shape, and a polygon (such as a triangle, a rectangle, a square, a diamond, a pentagon, a hexagon, a heptagon, an octagon, etc.), as well as combinations of these and other shapes, and that can correspond to a cross-sectional shape of an end and/or of another portion of the connector 30 (discussed below). Thus, although the drawings show certain preferred shapes of the at least one drum receiving portion 17, it is to be understood that the at least one drum receiving portion 17 can be of any shape, as long as the connector 30 can be disposed in the at least one drum receiving portion 17.

In a preferred embodiment of the invention, the at least one drum receiving portion 17 can include a plurality (i.e., at least two) of drum receiving portions 17, and more preferably can include two (2) pairs of drum receiving portions 17. Further, a quantity of the drum receiving portions 17 can correspond to a quantity of the connectors 30 (discussed below). Thus, in a preferred embodiment of the invention, the OPC drum 10 can include two (2) pairs of drum receiving portions 17 that correspond to two (2) connectors 30, and more preferably can include a first pair of drum receiving portions 17 in which a first connector 30 can be disposed, and can include a second pair of drum receiving portions 17 in which a second connector 30 can be disposed.

Further details of the at least one drum receiving portion 17 are discussed below with reference to the connector 30 as well as methods of assembling and/or grounding the coupling arrangement 100.

As shown in the drawings, the flange 20 (e.g., a driving flange that can be used to drive at least one component of at least one of a process cartridge that includes the coupling arrangement 100 and the EP machine and/or a driven flange) can include a flange interior surface 21 that can be disposed within the first open end 14 of the OPC drum 10, and can include a flange exterior surface 22 that can be disposed opposite to the flange interior surface 21 and outside of the first open end 14. The flange interior and exterior surfaces 21 and 22 can be about parallel to one another and can be about perpendicular to a longitudinal axis 23 of the flange 20, and the longitudinal axis 23 can be about perpendicular to the longitudinal axis 13 of the OPC drum 10 when the flange 20 is inserted into the first open end 14 of the OPC drum 10.

A flange side surface 24 can extend between the flange interior and exterior surfaces 21 and 22 and can be about perpendicular to the longitudinal axis 23. The flange side surface 24 can include a first profile 25 disposed adjacent to the exterior surface 22 and can include a second profile 26 disposed adjacent to the interior surface 21, the first and second profiles 25 and 26 extending along the longitudinal axis 23. The first profile 25 can include one or more geared driving teeth (e.g., spur and/or helical teeth) for driving at least one component of at least one of the process cartridge and the EP machine. The second profile 26 can be disposed within the OPC drum 10, and can be sized to achieve an interference fit with the interior surface 12 of the OPC drum 10. The first profile 25 can have a maximum diameter that is equal to or greater than a maximum diameter of the second profile 26, such that the flange side surface 24 can have a stepped profile. By this arrangement, when the flange interior surface 21 is inserted into the OPC drum 10, a step of the flange side surface 24 can abut an end of the first open end 14 of the OPC drum 10, such that complete insertion of the flange 20 into the OPC drum 10 can be achieved.

The flange 20 can include a grounding shaft opening 27 that extends between the flange interior surface 21 and the flange exterior surface 22 to communicate an interior and an exterior of the OPC drum 10. The grounding shaft opening 27 can be sized to achieve an interference fit with one or more surfaces of the grounding shaft 40 (discussed below). The grounding shaft opening 27 can be about concentric with, and can be about perpendicular to, the longitudinal axis 23 of the flange 20. The flange 20 can be of any material that can be used to drive at least one component of at least one of the process cartridge and the EP machine during the image forming process and/or that can be driven, such as an engineering plastic resin that can include at least one of a thermoplastic and/or a thermoset. Examples of such plastics can include polyacetals, nylons, and/or polyesters.

The flange 20 can include at least one flange receiving portion 28 to receive the connector 30 (discussed below). By this arrangement, the OPC drum 10 can be secured with and can be prevented from rotation and/or movement relative to the flange 20. The coupling arrangement 100 can be secured without the use of additional securing means, such as an adhesive and/or a press fit arrangement between the OPC drum 10 and the flange 20. Further, the coupling arrangement 100 can achieve electrical connection between the OPC drum 10 and the connector 30, and/or can ground the OPC drum 10 and the connector 30.

In a preferred embodiment of the invention, the at least one flange receiving portion 28 can have a shape that corresponds to a portion of a cross-sectional shape of the connector 30 (discussed below), and can be sized so as to achieve an interference fit with the connector 30 or alternatively so as to avoid an interference fit with the connector 30. Preferably, the at least one flange receiving portion 28 can have a shape that includes one or more of an arc, an ellipse, a circle, and an equivalent arcuate shape, and a polygon (such as a triangle, a rectangle, a square, a diamond, a pentagon, a hexagon, a heptagon, an octagon, etc.), as well as combinations of these and other shapes, and that can correspond to a cross-sectional shape of an end and/or of another portion of the connector 30 (discussed below). Thus, although the drawings show certain preferred shapes of the at least one flange receiving portion 28, it is to be understood that the at least one flange receiving portion 28 can be of any shape, as long as the connector 30 can be disposed in the at least one receiving portion 28. Further, the at least one flange receiving portion 28 can be formed during an initial manufacturing process of the flange 20 (e.g., during an injection molding of the flange 20), and/or can be formed after an initial manufacturing process of the flange 20 (e.g., by machining after the flange 20 is substantially otherwise completed).

The at least one flange receiving portion 28 can be disposed on the flange side surface 24 of the flange 20. In a preferred embodiment of the invention, the at least one flange receiving portion 28 can be disposed on the second profile 26 of the flange side surface 24 that can be disposed in the first open end 14 of the OPC drum 10. Although the drawings show certain preferred locations of the at least one flange receiving portion 28, it is to be understood that the at least one flange receiving portion 28 can be disposed at any position along the second profile 26, including at a position that can be adjacent to an edge of the first profile 25 of the flange side surface 24, and/or at a position that can be disposed apart from an edge of the first profile 25.

In a preferred embodiment of the invention, the at least one flange receiving portion 28 can include a plurality of flange receiving portions 28, and more preferably can include two (2) pairs of flange receiving portions 28. Further, a quantity of the flange receiving portions 28 can correspond to a quantity of the connectors 30 (discussed below). Thus, in a preferred embodiment of the invention, the OPC drum 10 can include two (2) pairs of flange receiving portions 28 that correspond to two (2) connectors 30, and more preferably can include a first pair of flange receiving portions 28 in which the first connector 30 can be disposed, and can include a second pair of flange receiving portions 28 in which the second connector 30 can be disposed.

Further details of the at least one receiving flange portion 28 are discussed below with reference to the connector 30 as well as methods of assembling and/or grounding the coupling arrangement 100.

The flange 20 can optionally include an adhesive channel (not shown) that can be used in conjunction with the at least one flange receiving portion 28 to secure with the OPC drum 10. The adhesive channel can be disposed on the flange side surface 24 of the flange 20, and can be disposed on the second profile 26 of the flange side surface 24 that can be disposed in the first open end 14 of the OPC drum 10. Further, it is to be understood that the adhesive channel can be disposed at any position along the second profile 26, including at a position that can be adjacent to an edge of the first profile 25 of the flange side surface 24, and/or at a position that can be disposed apart from an edge of the first profile 25.

As shown in the drawings, the connector 30 can be disposed in the at least one drum receiving portion 17 and the at least one flange receiving portion 28 to connect and/or to secure the OPC drum 10 and the flange 20. By this arrangement, the OPC drum 10 can be secured with and can be prevented from rotation and/or movement relative to the flange 20. The coupling arrangement 100 can be secured without the use of additional securing means, such as an adhesive and/or a press fit arrangement between the OPC drum 10 and the flange 20. Further, the coupling arrangement 100 can achieve electrical connection between the OPC drum 10 and the connector 30, and/or can ground the OPC drum 10 and the connector 30.

The connector 30 can include a first portion 31 that can be disposed in the at least one drum receiving portion 17 and a second portion 33 that can be received in the at least one flange receiving portion 28, examples of which are discussed below. The connector 30 can be in the form of a pin that can have a maximum diameter that is less than a length thereof.

The connector 30 can have a sufficient length such that the first portion 31 can form the at least one drum receiving portion 17 in the OPC drum 10, and/or such that the first portion 31 can remove the electrically resistive coating from the interior surface 12 of the OPC drum 10. The first portion 31 can have a cross-sectional shape that can correspond to the cross-sectional shape of the at least one drum receiving portion 17. Thus, the first portion 31 can include one or more of an arc, an ellipse, a circle, and an equivalent arcuate shape, and a polygon (such as a triangle, a rectangle, a square, a diamond, a pentagon, a hexagon, a heptagon, an octagon, etc.), as well as combinations of these and other shapes. Although the drawings show certain preferred shapes of the at first portion 31, it is to be understood that the first portion 31 can be of any shape, as long as the first portion 31 can be disposed in the at least one drum receiving portion 17.

The second portion 33 can be disposed in the at least one flange receiving portion 28 of the flange 20. The second portion 33 can have a shape that corresponds to a cross-sectional shape of the at least one flange receiving portion 28, and can be sized so as to achieve an interference fit with the at least one flange receiving portion 28 or alternatively can be sized so as to avoid an interference fit with the at least one flange receiving portion 28. Thus, the second portion 33 can include one or more of an arc, an ellipse, a circle, and an equivalent arcuate shape, and a polygon (such as a triangle, a rectangle, a square, a diamond, a pentagon, a hexagon, a heptagon, an octagon, etc.), as well as combinations of these and other shapes. Thus, although the drawings show certain preferred shapes of the second portion 33, it is to be understood that the second portion 33 can be of any shape, as long as the second portion 33 can be disposed in the at least one flange receiving portion 28.

In preferred embodiments of the invention, the connector 30 can include a plurality of connectors 30, and more preferably can include two (2) connectors 30 (i.e., the first connector 30 and the second connector 30). Further, the plurality of connectors 30 can correspond to the plurality of drum receiving portions 17 and/or the plurality of flange receiving portions 28. Thus, in preferred embodiments of the invention, the coupling arrangement 100 can include two (2) connectors 30 disposed in two (2) pairs of drum receiving portions 17 of the OPC drum 10 and/or disposed in two (2) pairs of flange receiving portions 28 of the flange 20. In more specific preferred embodiments of the invention, the first connector 30 can be disposed in both (i) the corresponding set of two (i.e., a first pair) flange receiving portions 28 that are about opposite to one another as well as (ii) a corresponding set of two (i.e., a first pair) drum receiving portion 17 that are disposed about opposite to one another, and the second connector 30 can be disposed in both (i) a corresponding set of two (i.e., a second pair) flange receiving portions 28 that are about opposite to one another as well as (ii) a corresponding set of two (i.e., a second pair) drum receiving portion 17 that are about opposite to one another. Further, the first and second connectors 30 can extend along respective axes (i.e., first and second axes). Portions of the first and second axes can extend about along straight lines and/or about along arcuate lines. Portions of the first and second axes can be about parallel to one another, can be about at an angle to one another, and/or can be about perpendicular to one another. Thus, in a preferred embodiment of the invention shown in the figures, the first and second connectors 30 can be about parallel to one another, and in another preferred embodiment of the invention shown in the figures, the first and second connectors 30 can be about perpendicular to one another.

As shown in the drawings, the grounding shaft 40 can include a first end 41 and can include a second end 45 extending about along an axis 49. At least one of the first end 41 and the second end 45 can include one or more faces, such that at least one or the first end 41 and the second end 45 can have a polygonal cross-section.

The first end 41 can include a driving engagement 42 for driving the OPC drum 10 during the image forming process. The driving engagement 42 can be sized, shaped, oriented, and/or otherwise disposed such that the grounding shaft 40 can be driven during the image forming process. Thus, although the drawings show certain preferred shapes of the driving engagement 42, it is to be understood that the driving engagement 42 can be of any shape, as long as the driving engagement 42 can be used to drive the OPC drum 10.

The second end 45 can include a contact portion 46 that can contact a portion of the connector 30 to achieve electrical connection therewith. In a preferred embodiment of the invention shown in the drawings, the contact portion 46 can contact first and second connectors 30 that are about parallel with one another. The contact portion 46 can contact the first and second connectors 30 that extend about along one or more arcuate lines, thereby ensuring that electrical connection can be achieved and/or maintained between the first and second connectors 30 and the grounding shaft 40, and can obviate the need for a grounding plate. In another preferred embodiment shown in the drawings, the contact portion 46 can contact first and second connectors 30 that are about at an angle to one another (e.g., first and second connectors that are about perpendicular to one another). Thus, by this arrangement, grounding of the OPC drum 10 (i.e., grounding of the first and second connectors 30 with the drum interior surface 12 of the OPC drum 10, and grounding of the first and second connectors 30 with the grounding shaft 40) can be achieved.

Methods of assembling the coupling arrangement 100 that can have the OPC drum 10 and the flange 20 can include disposing the connector 30 in the side surface 24 of the flange 20, and inserting the flange 20 that includes the connector 30 inside the OPC drum 10. The method can further include forming the at least one drum receiving portion 17 inside the OPC drum 10 with the connector 30, and/or removing the electrically resistive coating from the interior surface 12 of the OPC drum 10 with the connector 30.

Method of grounding the coupling arrangement having the OPC drum 10 and the flange 20 can include disposing the connector 30 in the side surface 24 of the flange 20, and inserting the flange 20 that includes the connector 30 inside the OPC drum 10 to achieve electrical connection between the inside of the OPC drum 10 and the connector 30. The method can further include forming the at least one drum receiving portion 17 inside the OPC drum 10 with the connector 30, and/or removing the electrically resistive coating from the interior surface 12 of the OPC drum 10 with the connector 30. The method can still further include disposing the grounding shaft 40 through the flange 20 to achieve electrical connection with the connector 30, and/or to ground the OPC drum 10 with the connectors 30 and the grounding shaft 40.

Further, it is to be understood that because the connector 30 need not be aligned with contact areas of the OPC drum 10, one or more of the above methods can be automated without regard to an angular orientation of the flange 20 that can include the connector 30 relative to the OPC drum 10.

FIG. 5 shows experimental results for strength tests of embodiments of the coupling arrangement 100. Experimental conditions for the new coupling arrangements include the use of an OPC drum having an outside diameter of 30 mm, one or two pins having a length of between 28.7 mm to 28.8 mm, and flanges including helical and spur gear teeth.

Numerous additional modifications and variations of the present invention are possible in light of the above teachings. For example, it is to be understood that the above-described teachings can be applied to any connection between an interior surface of a closed volume, a cover disposed at least partially within the interior of the closed volume, and a connector disposed in receiving portions of the closed volume and the cover. It is therefore to be understood that within the scope of the appended claims, the present invention may be practiced otherwise than as specifically described herein.

What is claimed is:

1. A coupling arrangement, comprising:

an optical photo-conductive drum including drum exterior and interior surfaces surrounding and extending along a longitudinal axis, the drum exterior surface facing away from the longitudinal axis, and the drum interior surface facing toward the longitudinal axis and including first and second open ends and at least one drum receiving portion;

a flange including a flange interior surface disposed in the first open end, a flange exterior surface disposed outside of the first open end, a flange side surface connecting the flange interior and exterior surfaces, and at least one flange receiving portion, the at least one flange receiving portion defining a void; and at least one connector disposed in the at least one drum receiving portion and through the at least one flange receiving portion to secure the optical photo-conductive drum and the flange.

2. The coupling arrangement according to claim 1, wherein the at least one flange receiving portion comprises two flange receiving portions.

3. The coupling arrangement according to claim 2, wherein the two flange receiving portions are disposed on the flange side surface about opposite to each other.

4. The coupling arrangement according to claim 3, wherein the at least one connector is disposed through the two flange receiving portions.

5. The coupling arrangement according to claim 4, wherein the two flange receiving portions are disposed in the flange side surface.

6. The coupling arrangement according to claim 5, wherein the flange side surface comprises first and second profiles extending along the longitudinal axis, the first profile having a first diameter and disposed in the first open end, and the second profile having a second diameter greater than the first diameter and disposed outside of the first open end, and the two flange receiving portions are disposed on the first profile.

7. The coupling arrangement according to claim 6, wherein the two flange receiving portions are disposed adjacent an edge of the second profile.

8. The coupling arrangement according to claim 6, wherein the two flange receiving portions are disposed apart from an edge of the second profile.

9. The coupling arrangement according to claim 6, wherein the at least one connector comprises at least one end adapted to form the at least one drum receiving portion.

10. The coupling arrangement according to claim 9, wherein the at least one drum receiving portion comprises two drum receiving portions, and the at least one end comprises two ends adapted to form the two drum receiving portions.

11. The coupling arrangement according to claim 10, wherein the at least one connector comprises a pin.

12. The coupling arrangement according to claim 11, wherein the pin is adapted to achieve electrical connection with the interior surface of the drum.

13. A coupling arrangement comprising:

an optical photo-conductive drum including drum exterior and interior surfaces surrounding and extending alone a longitudinal axis, the drum exterior surface facing away from the longitudinal axis, and the drum interior surface facing toward the longitudinal axis and including first and second one ends and at least one drum receiving portion;

a flange including a flange interior surface disposed in the first open end, a flange exterior surface disposed outside of the first oven end, a flange side surface connecting the flange interior and exterior surfaces, and at least one flange receiving portion; and at least one connector disposed in the at least one drum receiving portion and the at least one flange receiving portion to secure the optical photo-conductive drum and the flange, wherein the at least one flange receiving portion comprises a first pair of flange receiving portions and a second pair of flange receiving portions, and the at least one connector comprises a first connector disposed through the first pair of flange receiving portions and a second connector disposed through the second pair of flange receiving portions.

14. The coupling arrangement according to claim 13, wherein the first connector extends along a first axis and the second connector extends along a second axis, and portions of the first and second axes are disposed at an angle to each other.

15. The coupling arrangement according to claim 14, wherein the portions of the first and second axes are disposed about perpendicular to each other.

16. The coupling arrangement according to claim 13, wherein the first connector extends along a first axis and the second connector extends along a second axis, and portions of the first and second axes are about parallel to each other.

17. The coupling arrangement according to claim 16, further comprising:

a grounding shaft disposed through a portion of the flange to achieve electrical connection with the first and second connectors.

18. The coupling arrangement according to claim 16, wherein the connector contacts the grounding shaft and is adapted to achieve electrical connection with the grounding shaft.

19. The coupling arrangement according to claim 18, wherein contacting portions of the first and second axes that contact the grounding shaft extend about along straight lines.

20. The coupling arrangement according to claim 18, wherein contacting portions of the first and second axes that contact the grounding shaft extends about along arcuate lines.

21. A process cartridge adapted to be removably mounted on an electro-photographic machine, comprising:

the coupling arrangement according to claim 1.

22. An electro-photographic machine, comprising:

a main portion; and the coupling arrangement according to claim 1 removably mounted on the main portion.

23. A coupling arrangement, comprising:

an optical photo-conductive drum including drum exterior and interior surfaces surrounding and extending along a longitudinal axis, the drum exterior surface facing away from the longitudinal axis, and the drum interior surface facing toward the longitudinal axis and including first and second open ends and a first securing means;

a flange including a flange interior surface disposed in the first open end, a flange exterior surface disposed outside of the first open end, a flange side surface connecting the flange interior and exterior surfaces, and a second securing means, the second securing means defining at least one void; and connecting means disposed in the first securing means and disposed through the second securing means.

24. A method of assembling a coupling arrangement including an optical photo-conductive drum and a flange including an interior surface disposed inside the optical photo-conductive drum, an exterior surface disposed opposite the interior surface, and a side surface connecting the interior and exterior surfaces, the method comprising:

disposing a connector through a void in the side surface of the flange; and inserting the flange that includes the connector inside the optical photo-conductive drum.

25. The method according to claim 24, further comprising: forming a receiving portion inside the optical photo-conductive drum with the connector.

26. The method according to claim 24, wherein disposing the connector comprises disposing first and second connectors in the side surface of the flange.

27. The method according to claim 26, wherein portions of the first and second connectors extend about parallel to one another.

28. The method according to claim 26, wherein portions of the first and second connectors extend about perpendicular to one another.

29. The coupling arrangement produced by the method of claim 23.

30. A method of grounding a coupling arrangement including an optical photo-conductive drum and a flange including an interior surface disposed inside the optical photo-conductive drum, an exterior surface disposed opposite the interior surface, and a side surface connecting the interior and exterior surfaces, the method comprising:

disposing a connector through a void in the side surface of the flange; and inserting the flange that includes the connector inside the optical-photoconductive drum to achieve electrical connection between the inside of the optical photo-conductive drum and the connector and to secure the optical photo-conductive drum and the flange.

31. The method according to claim 30, further comprising:

disposing a shaft through the flange to achieve electrical connection with the connector.

32. The coupling arrangement produced by the method of claim 30.

* * * * *